United States Patent [19]

Andrews

[11] Patent Number: 4,508,277

[45] Date of Patent: Apr. 2, 1985

[54] APPARATUS FOR RECLAIMING FOUNDRY SAND

[76] Inventor: Robert S. L. Andrews, 7712 Incline Ter., Fort Worth, Tex. 76179

[21] Appl. No.: 346,235

[22] Filed: Feb. 5, 1982

Related U.S. Application Data

[63] Continuation-in-part of Ser. No. 185,206, Sep. 8, 1980, abandoned.

[51] Int. Cl.[3] ..... B02C 19/12; B22C 5/18

[52] U.S. Cl. ..... 241/65; 164/5; 164/412; 241/DIG. 10

[58] Field of Search ..... 164/412, 5; 241/DIG. 10, 23, 65

[56] References Cited

U.S. PATENT DOCUMENTS

| | | | |
|---|---|---|---|
| 2,433,738 | 12/1947 | Christensen | 241/DIG. 10 |
| 2,456,769 | 12/1948 | Christensen et al. | 241/65 X |
| 2,478,461 | 8/1949 | Connolly | 164/5 X |
| 4,144,088 | 3/1979 | Adams | 164/5 X |

FOREIGN PATENT DOCUMENTS

| | | | |
|---|---|---|---|
| 156380 | 11/1951 | Australia | 164/5 |
| 1958726 | 6/1971 | Fed. Rep. of Germany | 164/5 |
| 2252217 | 5/1974 | Fed. Rep. of Germany | 164/5 |
| 2508630 | 9/1975 | Fed. Rep. of Germany | 164/5 |
| 2708961 | 9/1978 | Fed. Rep. of Germany | 164/5 |
| 1172182 | 11/1969 | United Kingdom . | |

*Primary Examiner*—Nicholas P. Godici
*Assistant Examiner*—J. Reed Batten, Jr.
*Attorney, Agent, or Firm*—Charles D. Gunter, Jr.

[57] ABSTRACT

Used foundry sand is passed downward through a series of vertical, fluid sand beds. Hot air is forced upward in countercurrent fashion through the beds in turn so that a boiling action is achieved in the sand masses. The combination of thermal and abrasive action removes both organic resin and clay-bonded materials from the sand in one continuous operation.

3 Claims, 5 Drawing Figures

FIG. 3
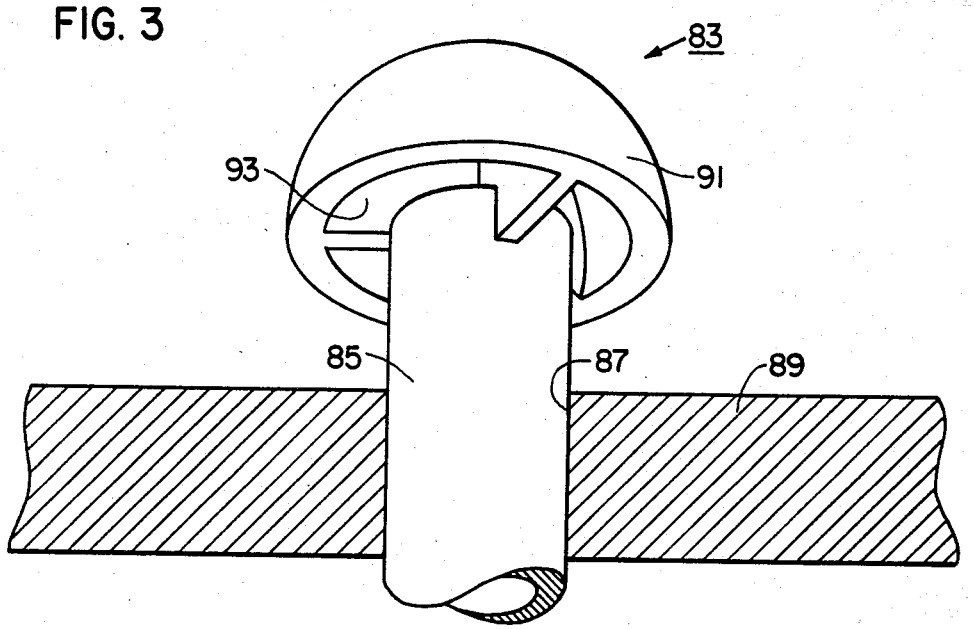
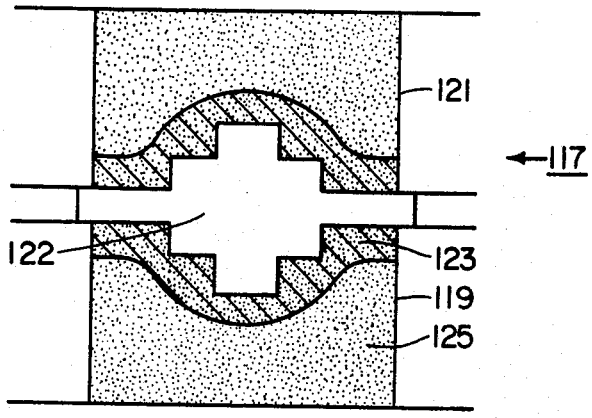
FIG. 4

APPARATUS FOR RECLAIMING FOUNDRY SAND

BACKGROUND OF THE INVENTION

This application is a continuation-in-part of application Ser. No. 185,206, filed Sept. 8, 1980 and now abandoned.

This invention relates generally to the treatment of used foundry sands, and more particularly, to the reclamation of foundry sands including both clay-bonded and organic resin-bonded sands and mixtures thereof.

Foundry sand is commonly used to make core molds into which ferrous and non-ferrous metals are cast. The core molds consist of sand bonded with special additives including inorganic binders such as clay, and organic resin binders, such as phenol, melamine, or urea formaldehyde.

Previously, after the casting has set within the mold, the mold was broken away and discarded. Various factors such as the deplation of natural sand deposits, the cost of disposing of used sand in accordance with recent environmental regulations have now made it economical and advantageous to reclaim the used sand for repeated use.

The type of binder used has, in the past, generally dictated the type of reclamation process utilized. Thus, for the inorganic, clay-bonded sands, so called "wet" and "dry" scrubbing techniques have been employed. U.S. Pat. No. 2,261,947 to Barnebl et al issued Nov. 11, 1941, entitled "Foundry Practice", utilizes the wet scrubbing method in which clay-bonded sands are cleaned in a blasting room by means of a high pressure stream of water and sand projected from guns. In the "dry" scrubbing technique, the "dry" sand is projected against an abrasive surface to crack off the clay binder. In both cases, the cleaning action is that of mechanical attrition.

For those sands utilizing the organic resin binders, thermal reclamation techniques have commonly been employed. For example, U.S. Pat. No. 2,478,461 to Connolly issued Aug. 9, 1949, entitled "Apparatus And Method For Treating Foundry Sand", discusses the reclaiming of foundry sand by heating or roasting treatment which causes the organic binders to be burned away. Thermal methods have commonly employed multiple-hearth type furnaces with mechanical "rabble arms" which worked over the used sand and moved the sand through the hearth at elevated temperatures.

None of the previously described techniques have proved entirely satisfactory for use in reclaiming both the clay-bonded and organic resin-bonded sands, as where a mixture of the sands is present. "Dry" scrubber reclaimers presently operating on clay-bonded sands have been found to have low rates of efficiency. This condition shows up as a gradual build-up of "binders" on the sand grains to the point where up to 50 percent of the reclaimed sand must be discarded over a period of time. "Wet" scrubbers, although more effective on clay-bonded sands, are not effective on organic resin bonded sands. Conversely, previous thermal techniques have proved effective for organic resin-bonded sands but not for clay-bonded sands. In addition, the rabble-roaster type multiple hearth furnace used previously is expensive to set up and maintain due to the necessity for operating the mechanical moving parts in high temperature environments and due to high initial cost of the high alloy, heat resistant metal components.

SUMMARY OF THE INVENTION

It is, therefore, an object of the present invention to provide a method and apparatus for reclaiming used foundry sand of the clay-bonded and organic resin-bonded types, included mixtures thereof, in one operation.

Another object of the present invention is to provide a method and apparatus for reclaiming clay-bonded and organic resin-bonded sands which is relatively inexpensive to set up and maintain as compared to existing systems.

Accordingly, in the present method, used sand which is to be reclaimed is passed downward through a series of vertical chambers. The first chamber is a preheat chamber in which the entering sand is heated from ambient temperatures to the range of 700°-900° F. A metered amount of sand is allowed to flow from the preheat chamber downward into a calcining chamber where the sand temperature is maintained in the range of 1400°-1800° F. A metered amount of sand then flows downward from the calcining chamber to a cooling chamber where the sand temperature is in the range of 700°-900° F. until being removed for reuse. The sand mass contained in each of the chambers is heated by forcing hot air upward in countercurrent fashion through each of the chambers in turn so that the sand mass behaves like a liquid at its boiling point.

The transfer of sand downward through the series of beds is preferably accomplished by means of side chutes which contain metering devices to pass a predetermined quantity of sand in a given time interval. By metering the flow of sand between the successive vertical chambers, the desired average retention time of sand in the calcining chamber can be achieved.

Preferably, additional heat from a nozzle burner is supplied to the upwardly passing air at a point above the sand mass in the cooling chamber to raise the temperature of the sand in the calcining chamber to within the 1400°-1800° F. range and provide excess heat to the preheat chamber above. In this manner the excess heat from the calcining chamber is used to preheat the ambient sand entering the system, thereby conserving energy.

The combined abrasive action of the "boiling" sand masses and thermal treatment removes both clay and organic resin binders from the sand grains. The reclaimed sand which is removed from the cooling chamber can be cooled and reused in the casting process.

BRIEF DESCRIPTION OF THE DRAWINGS

FIG. 3 is a perspective view of a vent used in carrying out the process of the invention;

FIG. 4 is a core mold of the type used to cast ferrous and non-ferrous metals.

DETAILED DESCRIPTION OF THE INVENTION

Figure 1:
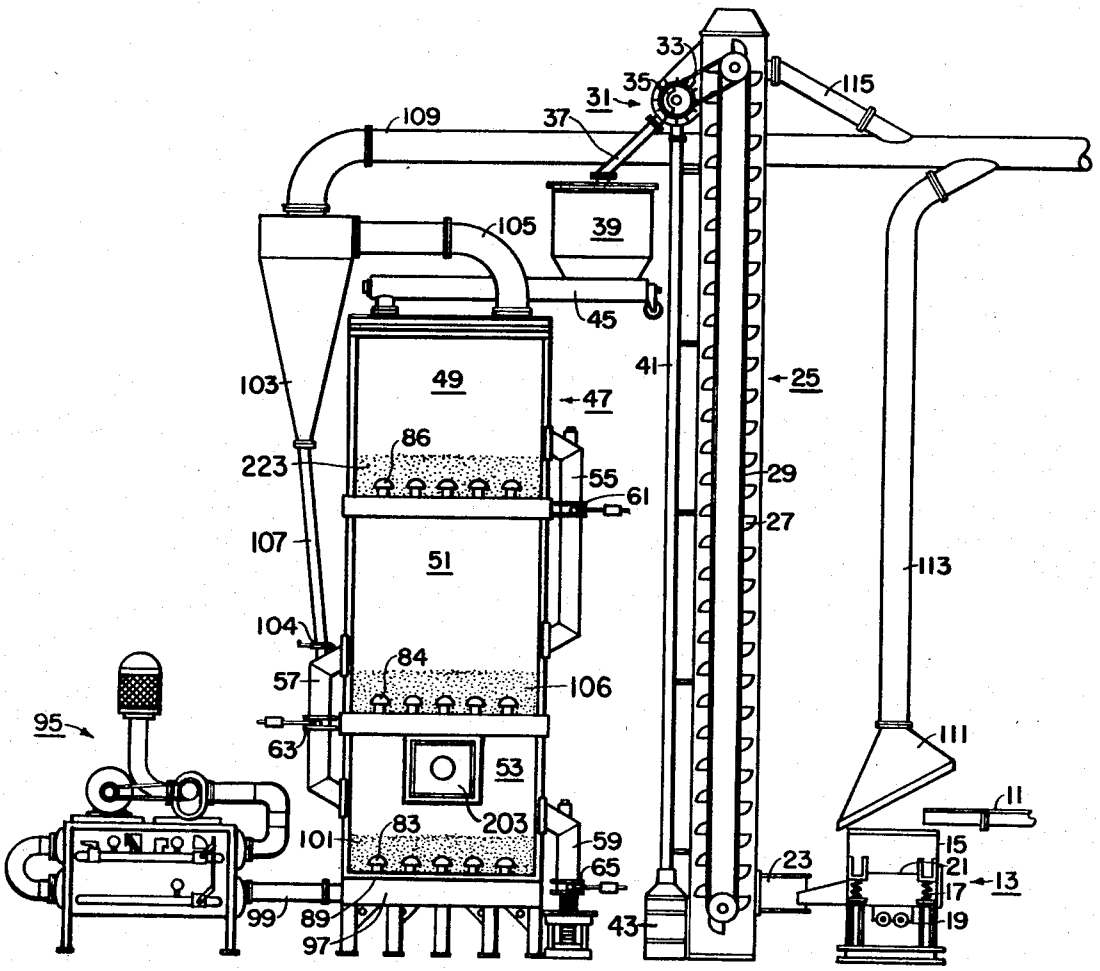
FIG. 1 is a schematic diagram showing the apparatus of the present invention and its operation.

Referring now to FIG. 1, there is shown a portion of a conventional conveyor 11 for conveying used sand from the casting area. Conveyor 11 empties into a lump reducer mill 13 comprising a steel box 15 mounted on springs 17 and having vibrating means 19 for violently agitating the box 15. A mesh screen 21 in lump reducer mill 13 allows particles of ⅛ inch diameter and smaller to pass to the boot 23 of a bucket elevator 25. Bucket elevator 25 has a series of buckets 27 mounted on a driven belt 29. Buckets 27 scoop up material in the boot 23 and discharge the same over a rotating drum 31. Drum 31 has a series of cleats 33 mounted on the exterior surface and a hollow interior within which is mounted a stationary magnet 35. Magnet 35 is selectively positioned to attract and hold metallic particles on the drum surface as the drum revolves past hopper chute 37. As the drum surface revolves past the magnetic field created by magnet 35 and passes discharge chute 41, the metallic particles are released and fall down chute 41 to a waste bin 43.

The non-metallic material passing down hopper chute 37 falls into a surge hopper 39. Surge hopper 39 is positioned above a screw conveyor 45 which is motor driven through a gear reducer preset to provide a controlled discharge rate of material into the top of the reclaimer vessel 47.

Vessel 47 includes a preheat chamber 49, a calcining chamber 51 located directly beneath the preheat chamber 49 in vertical fashion, and a cooling chamber 53 similarly located beneath the calcining chamber 51. Gate means comprising a series of chutes 55, 57 and 59, having dribble valves 61, 63 and 65, respectively, allow metered flow of material downwardly between successive chambers and out of the vessel.

Figure 2:
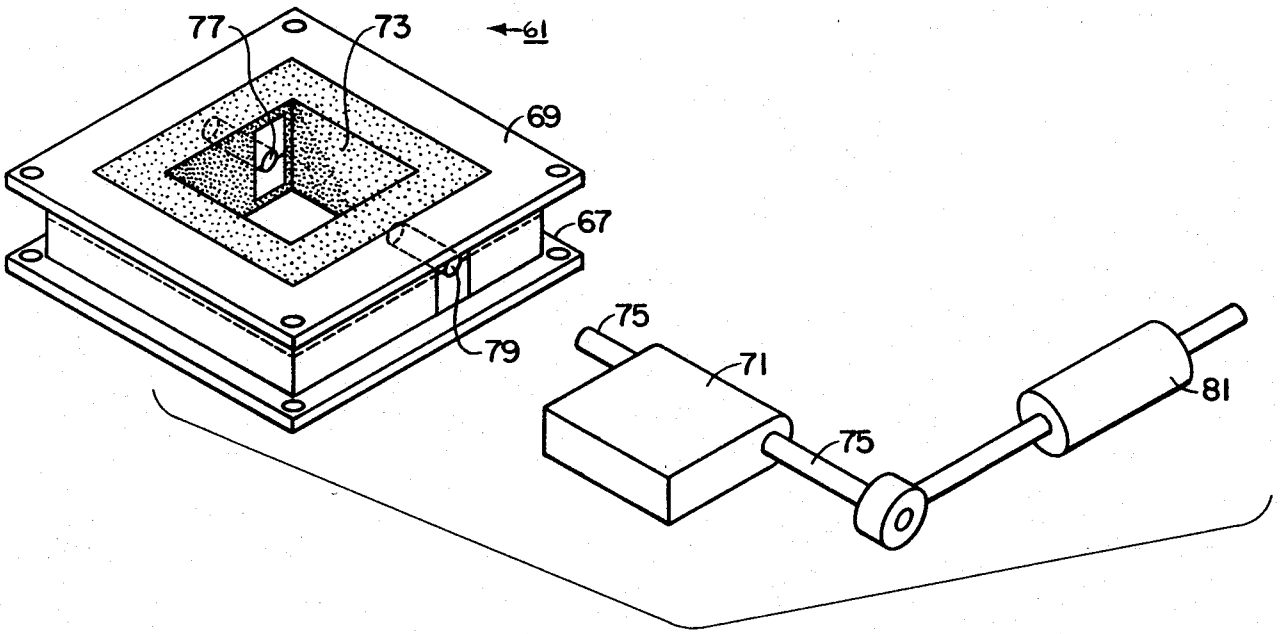
FIG. 2 is an exploded view of a dribble valve used in carrying out the process of the invention.

FIG. 2 is an exploded view of a dribble valve 61 including a frame 67, top 69, and paddle 71. When top 69 is removed, paddle 71 is inserted within recess 73 of frame 67. A shaft 75 extends from either side of paddle 71 and rides in cylindrical openings 77 and 79. A counterweight 81 is attached to the end of shaft 75 extending from opening 79. With top 69 in place, paddle 71 can move to open or close off recess 73. The size of counterweight 81 determines the quantity of sand which must build up inside the chute before paddle 71 can be rotated downwardly, thereby releasing the accumulated sand into the next lower chamber.

A plurality of vents 83, 84 and 86, are mounted in the floors of each of the vertical chambers 53, 51 and 49, respectively, for passing hot air upward in countercurrent fashion. FIG. 3 shows a vent 83 in greater detail. Vent 83 comprises a hollow cylinder 85 extending through an opening 87 in the chamber floor 89 and a dome-shaped cover 91 designed to allow hot air to pass up cylinder 85 and out opening 93 but to restrict the flow of sand downward between chambers.

A rotary blower 95 of conventional design is connected to the base 97 of the cooling chamber 53 by a pipe 99 and provides an upward flow of hot air through vents 83, 84 and 86, between successive chambers 53, 51 and 49, respectively. A suitable rotary blower can be obtained from MD Pneumatics, Inc., of Springfield, Missouri.

A nozzle burner 203 is connected to the side of the cooling chamber 53 above the sand level 101 in the chamber for introducing additional heat into the upwardly moving air, thereby generating excess heat in the calcining chamber 51. The excess heat generated in the calcining chamber passes upward through vents 86 to preheat sand entering a preheat chamber 49.

A cyclone collector 103 is mounted adjacent the reclaimer 47 and connects to the preheat compartment 49 by an exhaust duct 105. Hot gases passing upward through chambers 53, 51 and 49 respectively, pick up and transport fine sand grains out exhaust duct 105. Cyclone collector 103 separates and returns particles of approximately 200 mesh and larger to the cooling chamber 53 by means of pipe 107 and slide gate 104 which connects to side chute 57. Very fine particles travel up overhead duct 109 and out of the system.

Dust control is also provided by hood 111 over the lump reducing mill 13 which is connected by pipe 113 to overheat duct 109. Exhaust pipe 115 allows dust from the bucket elevator 25 to to pass into overhead duct 109 and be carried out of the system.

The operation of the system will now be described in greater detail. FIG. 4 shows a typical core mold 117 used in casting operations comprising a drag flask 119 and mirror image cope flask 121. Sandwiched between the two flasks 119 and 121, is a pattern 122. Core mold 117 is preferably backed by a layer of organic resin-bonded sand 123 and a greater mass of clay-bonded sand 125. Since the relative cost of organic resin-bonded sand to clay-bonded sand is approximately 10:1 at the present time, a rigid mold faced with resin-bonded sand but backed with clay-bonded sand is most economical. Such an arrangement provides the cheapness of clay-bonded sand but with the cleanliness and precision of organic resin-bonded sands.

Once the casting process is completed, the core mold 117 is broken up and passed over a shake-out screen deck in the casting area and from there to the used sand conveyor 11. Thus, material entering the system on conveyor 11 will include damp clay-bonded sand, burnt-out core sand and lumps of resin-bonded sand. A small percentage of metallic trash such as nails, spill shot, and flash metal will also be present.

The used material passes over conveyor 11 to lump reducing mill 13 where it is broken up into particles ⅛ inch diameter and smaller. The particles pass through screen 21 to boot 23. Bucket elevator 25 picks up the particles of material and dumps the same over revolving drum 31 where metallic wastes are separated into waste bin 43 allowing the remaining material to pass to surge hopper 39.

Screw conveyor 45 continuously feeds a predetermined amount of material into the top of the preheat chamber 49. Hot air from rotary blower 95 passes through vents 83, 84, and 86 upwards to fluidize the sand mass 223 in chamber 49, causing sand to pass down side chutes 55 and 57 to chambers 51 and 53.

Air is introduced into the bed of chamber 53 at about 70°–90° F. to provide approximately 2–3 psi pressure in sand mass 101. Hot sand entering chamber 53 through chute 57 is cooled in the range of 700°–900° F. by the relatively cooler 70°–90° F. air entering the cooling chamber 53.

Additional heat is provided to the upwardly moving air by nozzle burner 203 above sand mass 101 in order to maintain the temperature of the sand mass 106 in the calcining chamber in the range of 1400°–1800° F. and provide excess heat to the preheat chamber 49 above. The volume of air supplied by rotary blower 95 is calculated to provide approximately 200 percent excess over that needed to support the combustion taking place in the calcining chamber 51. The upwardly moving gases pass through vents 86 into the preheat chamber to heat the incoming ambient sand in the range of 700°–900° F.

By metering the flow of sand through side chutes 55, 57 and 59, the average retention time of same in the calcining chamber 51 can be set. The flow rate through the chutes is determined by the size of the counterweight used on the dribble valves 61, 63 and 65, as has been explained. The flow rate should be set to allow an average retention time in the calcining chamber 51 of at least 10 minutes. Reclaimed sand passes out chute 59 to be reused to the casting operation.

Figure 5:
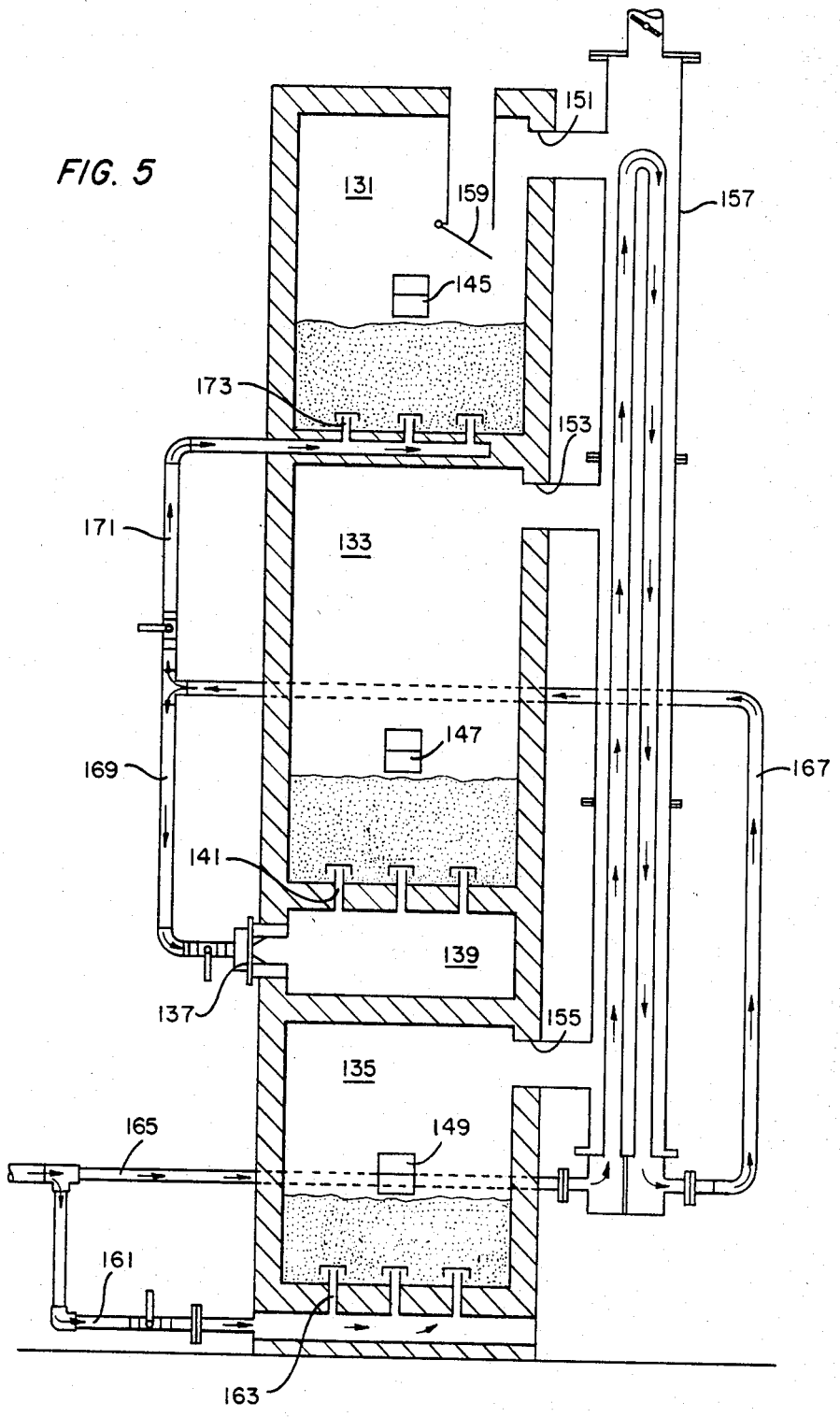
FIG. 5 is a schematic diagram showing an alternative embodiment of the invention of FIG. 1.

FIG. 5 shows an alternative embodiment of the invention of FIG. 1. In the apparatus of FIG. 5, there is once again a preheat chamber 131, a calcining chamber 133 located below the preheat chamber 131 and a cooling chamber 135 located below the calcining chamber. In the device shown in FIG. 5, however, a nozzle burner 137 is mounted in a sealed firebox 139 located immediately above the cooling chamber 135 and immediately below the calcining chamber 133. The products of combustion in firebox 139 are vented through a plurality of vents 141 in the roof of the firebox 139 which is also the floor of the calcining chamber 133.

Each of chambers 131, 133, and 135 has a chute 145, 147 and 149, respectively, for allowing a metered amount of sand to flow downward through the successive chambers in the manner previously described. In this case, however, each of chambers 131, 133, and 135 has a chamber flue 151, 153 and 155 communicating the respective chambers to an air to air heat exchanger 157. In this way, the means for utilizing waste heat from the three chamber flues 151, 153 and 155 is by flowing the heat through air to air heat exchanger 157 to preheat the nozzle burner 137 combustion air and to heat the preheat chamber 131 air.

The operation of the apparatus of FIG. 5 will now be described in greater detail. Used material enters the preheated chamber 131 from screw conveyor 45 through chute 159. Hot air from rotary blower 95 passes through line 161 and vents 163 through the sand mass in chamber 135. Waste heat passes out flue 155 to heat exchanger 157. Hot air from rotary blower 95 passes through line 165, through heat exchanger 157 (as shown by the arrows in FIG. 5), is further heated by the action of hot gases from flues 155, 153, and 151, and passes out line 167. Hot gas in line 167 flows through line 169 to preheat the nozzle burner 137 combustion air and through line 171 and vents 173 to heat the pre-heat chamber 131. Heat exchanger 157 utilizes waste heat from flues 151, 153 and 155 to enhance the hot air supplied from the rotary blower 95, thereby supplying 600° F. air to nozzle burner 137 to further improve the efficiency of the system. In other respects, the operation of the apparatus of FIG. 5 is identical to that shown in the apparatus of FIG. 1.

It should be apparent from the foregoing that an invention with significant advantages has been provided. By passing hot air upward in countercurrent fashion to the downward movement of sand through the chambers, the sand mass in the chambers acts like a liquid at its boiling point, resulting in abrasion of the sand particles. The combination of abrasion and thermal treatment removes both organic resin and clay binders from the sand particles in one operation.

Excess heat from the calcining chamber is used to preheat sand entering the chamber directly above, thus contributing to the efficiency of the operation. Alternatively, waste heat from the preheat, calcining and cooling chambers can be used with an external heat exchanger to preheat the nozzle burner combustion air and to heat the air in the preheat chamber. There are no mechanical moving parts operating in the calcining zone as in the prior rabble-roaster type furnaces, thus lessening the chance of mechanical failure.

While the invention has been shown in only two of its forms, it should be apparent to those skilled in the art that it is not so limited but is susceptible to various changes and modifications without departing from the spirit thereof.

I claim:

1. An apparatus for reclaiming foundry sand, comprising:

a preheat chamber having sidewalls, a floor, and an opening for receiving sand to be reclaimed;

a calcining chamber having sidewalls and a floor located directly beneath the floor of said preheat chamber in vertical fashion, said calcining chamber being connected to said preheat chamber by an external chute having a continuously open passageway for allowing the flow of sand downwardly between said preheat and calcining chambers;

a cooling chamber having sidewalls and a floor located beneath said calcining chamber in vertical fashion and being connected to said calcining chamber by an external chute having a continuously open passageway which allows the flow of sand downwardly between said calcining and cooling chambers;

vent means in the floors of said preheat chamber and cooling chamber for passing air upwardly through said chambers;

a firebox having a floor, sidewalls and a roof located immediately above said cooling chamber and immediately below said calcining chamber, said firebox having vent means in the roof thereof which is also the floor of said calcining chamber;

burner means mounted in said firebox for producing combustion within said firebox, the products of combustion in said firebox being vented through said firebox vent means into said calcining chamber to thereby generate excess heat in said calcining chamber; and a blower unit for introducing air into the vent means of said preheat chambers and cooling chambers, as well as into said firebox, whereby sand is moved through said external passageways successively downwardly between said preheat calcining and cooling chambers.

2. An apparatus for reclaiming foundry sand, comprising:

a preheat chamber having sidewalls, a floor, and an opening for receiving sand to be reclaimed;

a calcining chamber having sidewalls and a floor located directly beneath the floor of said preheat chamber in vertical fashion, and calcining chamber being connected to said preheat chamber by an external chute having a continuously open passageway for allowing the flow of sand downwardly between said preheat and calcining chambers;

a cooling chamber having sidewalls and a floor located beneath said calcining chamber in vertical fashion and being connected to said calcining chamber by an external chute having a continuously open passageway which allows the flow of sand downwardly between said calcining and cooling chambers;

vent means in the floors of said preheat chamber and cooling chamber for passing air upwardly through said chambers;

a firebox having a floor, sidewalls and a roof located immediately above said cooling chamber and immediately below said calcining chamber, said firebox having vent means in the roof thereof which is also the floor of said calcining chamber;

burner means mounted in said firebox for producing combustion within said firebox, the products of combustion in said firebox being vented through said firebox vent means into said calcining chamber to thereby generate excess heat in said calcining chamber;

a heat exchanger connected to each of said preheat, calcining and cooling chambers by means of a chamber flue, said heat exchanger having an internal passageway which is exposed to waste heat exiting each of said chamber flues;

a blower unit for introducing air into the vent means of said cooling chamber and for introducing air into said heat exchanger internal passageway; and a connecting conduit for supplying heated air from said heat exchanger internal passageway to the vent means of said preheat chamber, whereby sand is moved through said external passageways successively downwardly between said preheat, calcining and cooling chambers.

3. An apparatus for reclaiming foundry sand, comprising:

a preheat chamber having sidewalls, a floor, and an opening for receiving sand to be reclaimed;

a calcining chamber having sidewalls and a floor located directly beneath the floor of said preheat chamber in vertical fashion, the sidewalls of said calcining chamber being connected to the sidewalls said preheat chamber by an external chute having a continuously open passageway for allowing the flow of sand downwardly between said preheat and calcining chambers;

a cooling chamber having sidewalls and a floor located beneath said calcining chamber in vertical fashion, the sidewalls of said cooling chamber being connected to the sidewalls of said calcining chamber by an external chute having a continuously open passageway which allows the flow of sand dowmwardly between said calcining and cooling chambers;

vent means in the floors of said preheat chamber and cooling chamber for passing air upwardly through said chambers.

a firebox having a floor, sidewalls and a roof located immediately above said cooling chamber and immediately below said calcining chamber, said firebox having vent means in the roof thereof which is also the floor of said calcining chamber;

burner means mounted in said firebox for producing combustion within said firebox, the products of combustion in said firebox being vented through said firebox vent means into said calcining chamber to thereby generate excess heat in said calcining chamber;

a heat exchanger connected to each of said preheat, calcining and cooling chambers by means of a chamber flue located above the sand level in each of said chambers, said heat exchanger having an internal passageway which is exposed to waste heat exiting each of said chamber flues;

a blower unit for introducing air into the vent means of said cooling chamber and for introducing air into said heat exchanger internal passageway; and connecting conduits for supplying heated air from said heat exchanger internal passageway to the vent means of said preheat chamber as well as into said firebox whereby sand is moved through said external passageways successively downwardly between said preheat, calcining and cooling chambers, and said heat exchanger air is used to heat the burner combustion air and to heat the preheat chamber air.

* * * * *